US011560771B2

(12) United States Patent
Hern

(10) Patent No.: US 11,560,771 B2
(45) Date of Patent: Jan. 24, 2023

(54) WET CONNECT POCKET WASHOUT, METHOD, AND SYSTEM

(71) Applicant: Christopher Hern, Porter, TX (US)

(72) Inventor: Christopher Hern, Porter, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/357,063

(22) Filed: Jun. 24, 2021

(65) Prior Publication Data

US 2022/0412190 A1 Dec. 29, 2022

(51) Int. Cl.
*E21B 37/00* (2006.01)
*E21B 17/00* (2006.01)

(52) U.S. Cl.
CPC ..... *E21B 37/00* (2013.01); *E21B 17/006* (2013.01)

(58) Field of Classification Search
CPC ..... E21B 37/00; E21B 17/021; E21B 17/006
See application file for complete search history.

(56) References Cited

U.S. PATENT DOCUMENTS

| | | | | |
|---|---|---|---|---|
| 7,213,657 | B2 * | 5/2007 | Vold | E21B 47/00 166/162 |
| 2006/0260818 | A1 * | 11/2006 | Meijer | E21B 17/023 166/380 |
| 2008/0029274 | A1 * | 2/2008 | Rytlewski | E21B 17/1035 166/380 |
| 2009/0045146 | A1 * | 2/2009 | Stoesz | E21B 23/00 210/470 |
| 2017/0016293 | A1 * | 1/2017 | Thomas | E21B 47/12 |

* cited by examiner

*Primary Examiner* — David Carroll
(74) *Attorney, Agent, or Firm* — Cantor Colburn LLP

(57) ABSTRACT

A wet connect system including a connector housing, a wet connector disposed in a pocket of the housing, a washout window in the pocket and a washout outlet in the pocket, the washout outlet fluidly connected to a washout pathway, the pathway at least partially within the housing.

18 Claims, 11 Drawing Sheets

WET CONNECT POCKET WASHOUT, METHOD, AND SYSTEM

BACKGROUND

In the resource recovery and fluid sequestration industries, making connections in the downhole environment, be they electrical, optical, hydraulic, etc. need to be made. Difficulties in making such connections are usually associated with debris that has collected at the connection site. Efforts to clean this area have been tried with varying success. The art would well receive additional configurations that provide for clean connection areas.

SUMMARY

An embodiment of a wet connect system including a connector housing, a wet connector disposed in a pocket of the housing, a washout window in the pocket and a washout outlet in the pocket, the washout outlet fluidly connected to a washout pathway, the pathway at least partially within the housing.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
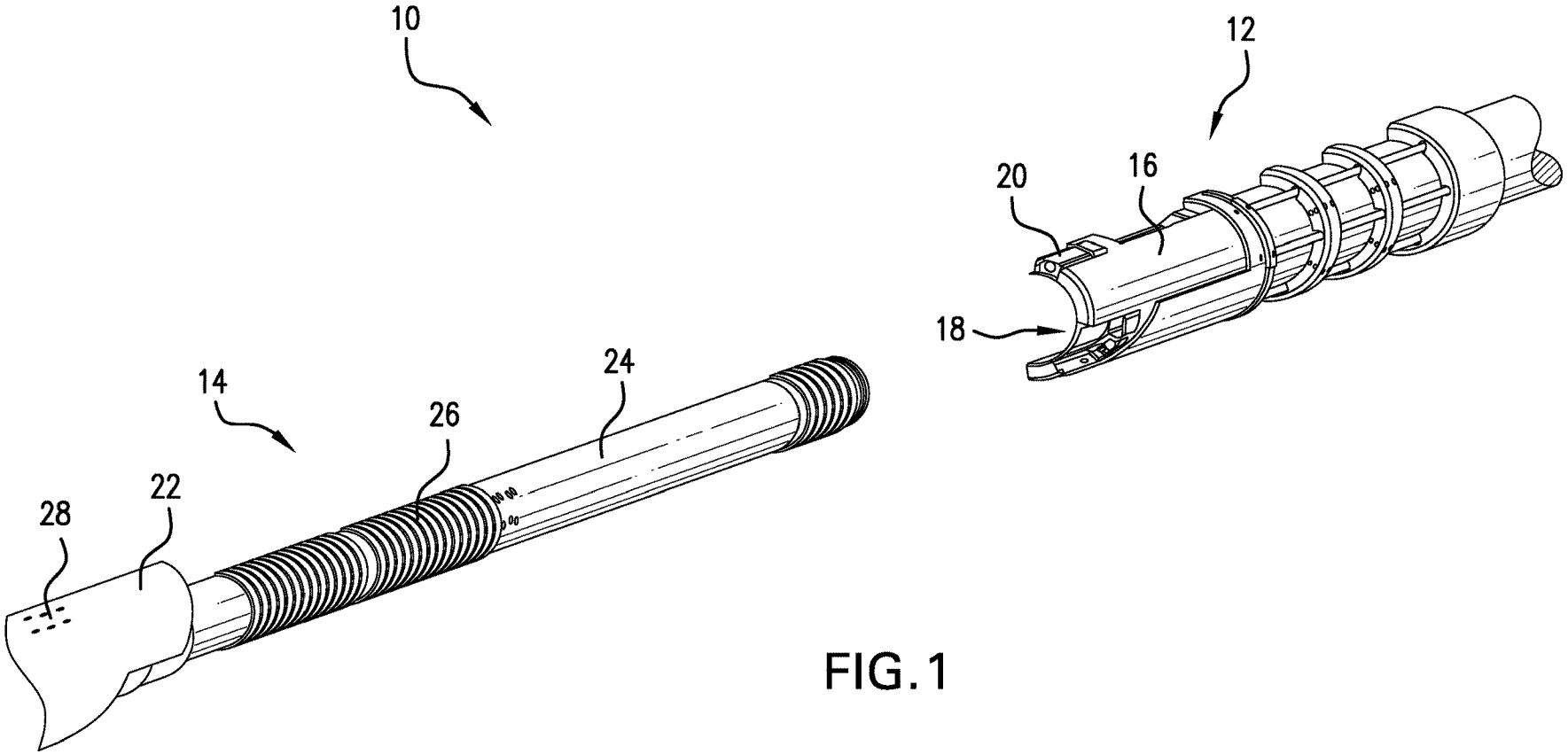
FIG. 1 is a perspective view of a wet connect system as disclosed herein.

Referring to FIG. 1, a wet connect system 10 is illustrated in a position prior to connection. The system 10 includes a connect assembly 12 and a mate assembly 14, which may be parts of different strings that are joined when connect assembly 12 and mate assembly 14 are connected. The connect assembly 12 includes a connector housing 16. The connector housing 16 defines a connector pocket 18, and a connector 20 is illustrated disposed therein. While only one connector 20 is shown, it will be appreciated that each pocket 18 is configured to receive two connectors 20 and there may be one or more pockets 18 defined by the connector housing 16. Before moving to FIG. 2 for more detail on connector housing 16, the mate assembly 14 includes a mating housing 22, a mating tubular 24, seals 26 and a mating wet connector 28.

Figure 2:
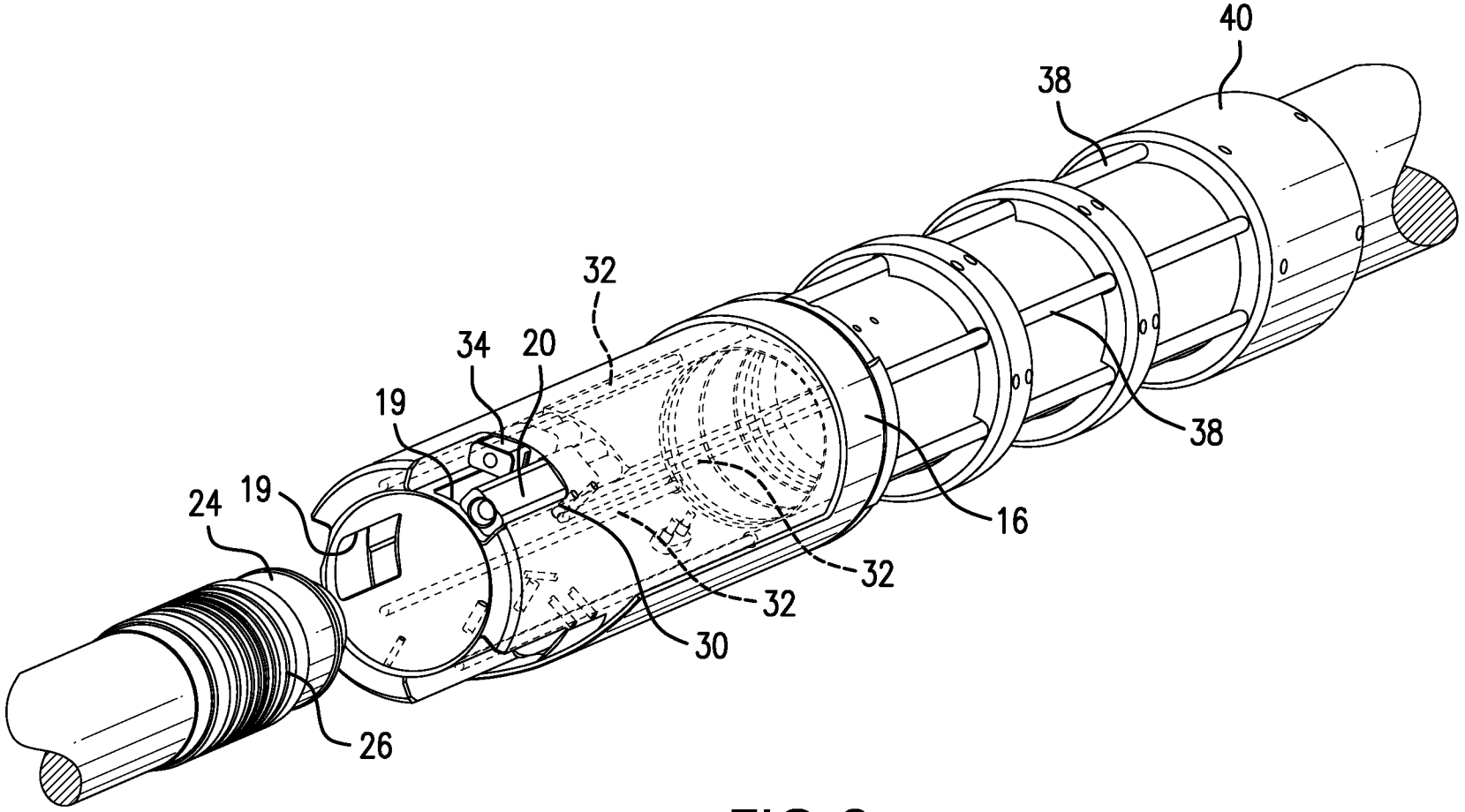
FIG. 2 is a perspective partially transparent view of a portion of the wet connect system illustrated in FIG. 1.
Figure 3:
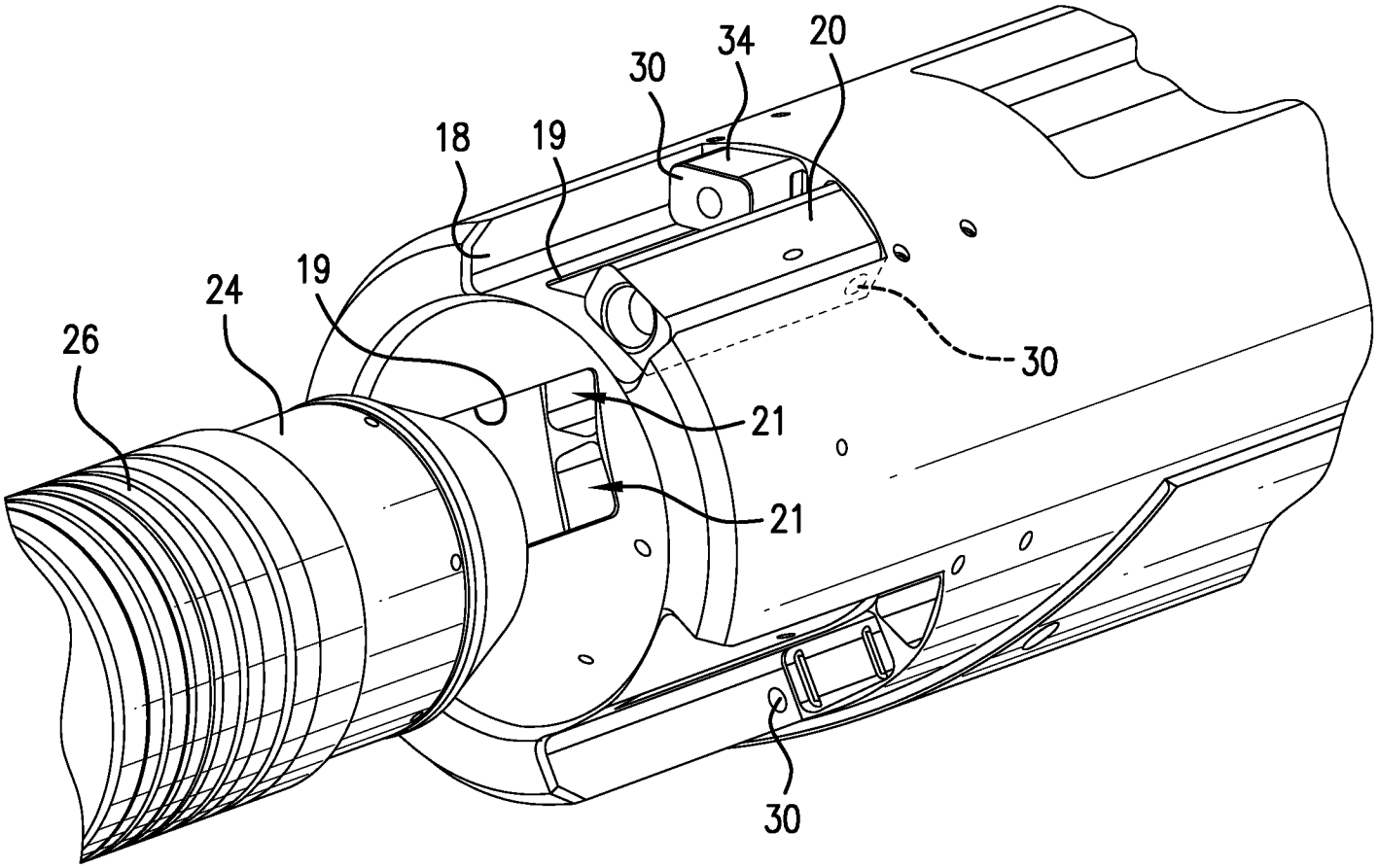
FIG. 3 is another view of the same portion of the system as illustrated in FIG. 2.

Referring to FIGS. 2 and 3, enlarged views of the system 10 are focused upon the connector housing 16 (transparent) and its immediate surroundings will provide edification. Pocket 18 includes a washout window 19 and a washout outlet 30 for a washout pathway 32 through which fluid is pumped at a desired time in order to wash debris out of the pocket 18. As was noted above, there may only be one connector 20 in a pocket. If that be the case, it is sometimes desirable to plug the other connector opening 21 with a deflector 34, which may not only block the connector opening 21 in the connector housing 16 but also may extend in front of the outlet 30 thereby causing fluid expelled from the outlet 30 deflect into multidirectional flow. In some embodiments the deflector 34 improves the eddy currents of the washout fluid to enhance the lifting power of the fluid for debris in the pocket 18. The washout pathway 32 extends through the connector housing 16 and optionally through pathway tubes 38 to a manifold ring 40.

Figure 4:
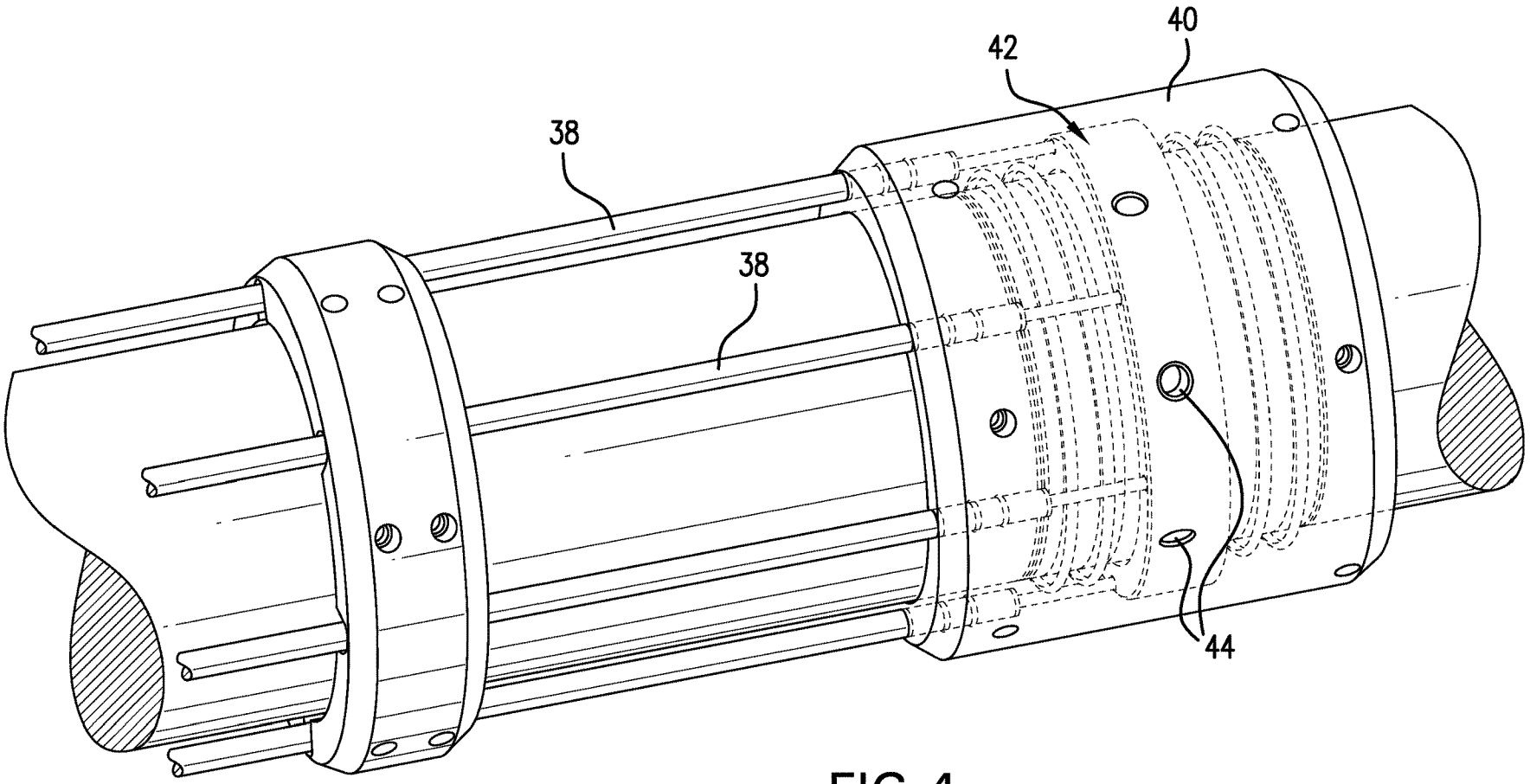
FIG. 4 is a perspective partially transparent view of another portion of the wet connect system illustrated in FIG. 1.
Figure 5:
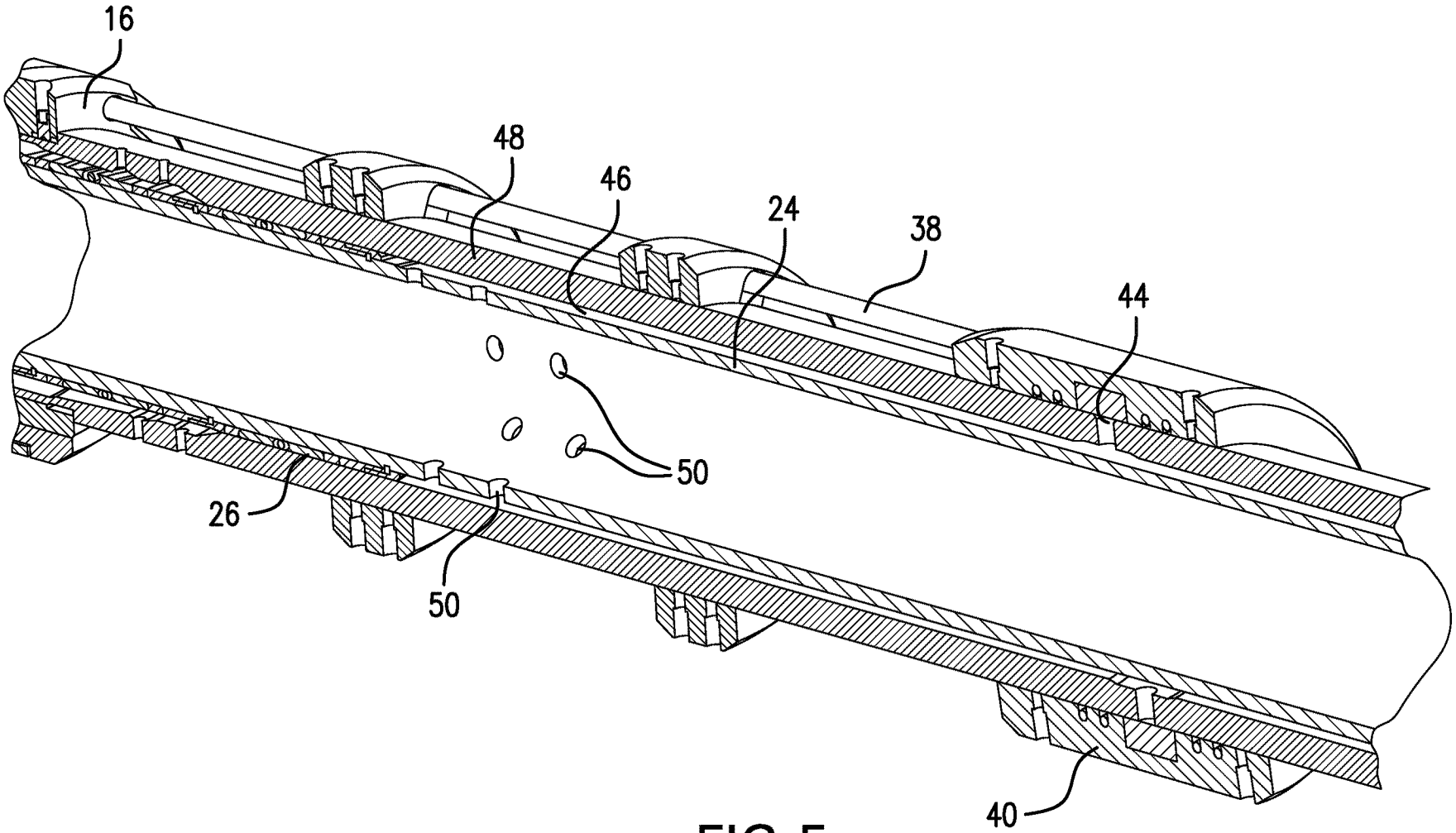
FIG. 5 is a perspective cross sectional view of a portion of the system illustrated in FIG. 1.

Referring to FIG. 4, the manifold ring 40 is illustrated in transparent form. Ring 40 includes a manifold 42 that is in fluid communication with tubes 38 and in fluid communication with inlets 44. Moving to FIG. 5, it will be appreciated that the inlet(s) 44 are supplied by fluid pumped through the tubular 24 that is directed to an annular space 46 between the tubular 24 and a mandrel 48 of the connector assembly 12 through openings 50 in the tubular 24. It will be noted that the seals 26 prevent flow in the annular space 46 in a direction away from the inlet 44. It is important to note that the FIG. 5 view shows the system fully connected and that there are a number of positions with different functions between when the assemblies 12 and 14 are separated as shown in FIG. 1 and fully seated as shown in FIG. 5. These are addressed in FIGS. 6A-6D.

Figure 6A:
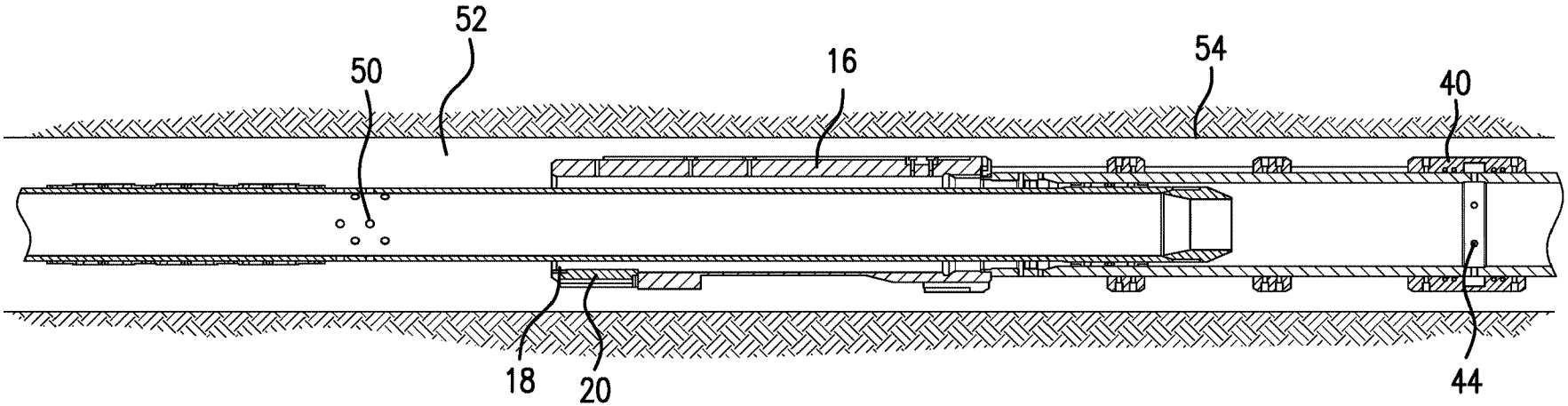
FIGS. 6A-6E are a series of cross section views illustrating various operational positions of the wet connect system disclosed herein.
Figure 6B:
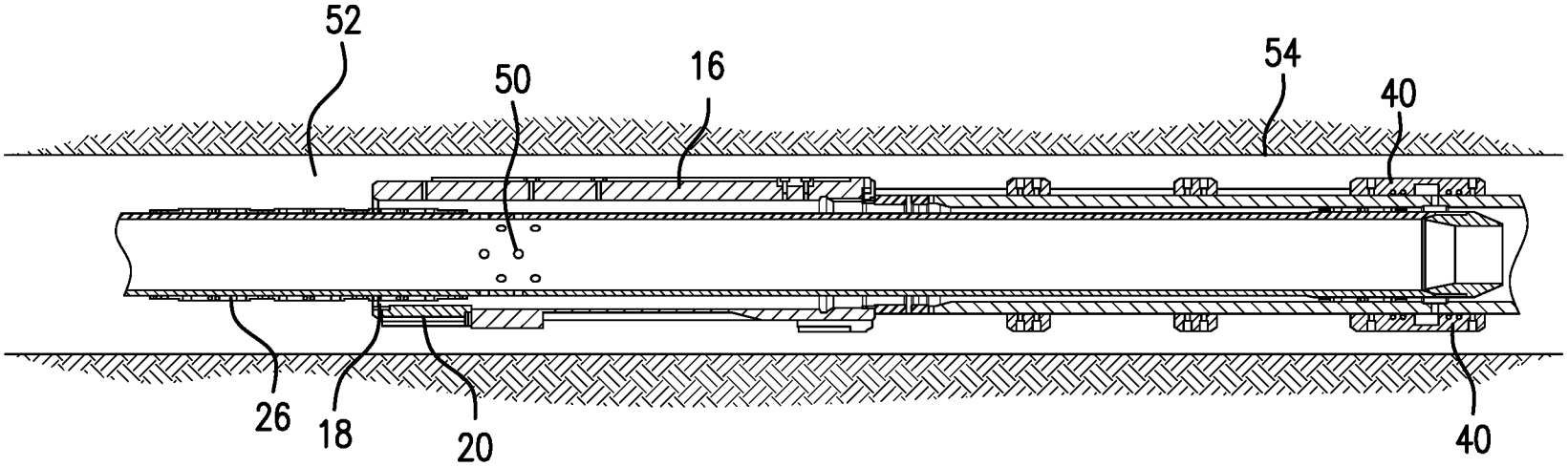
Figure 6C:
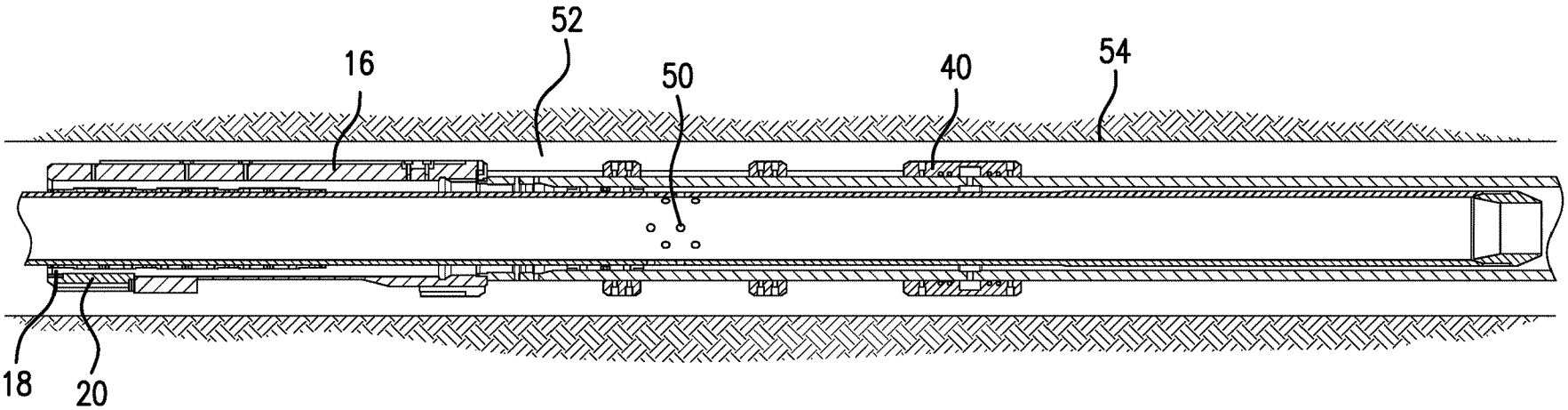
Figure 6D:
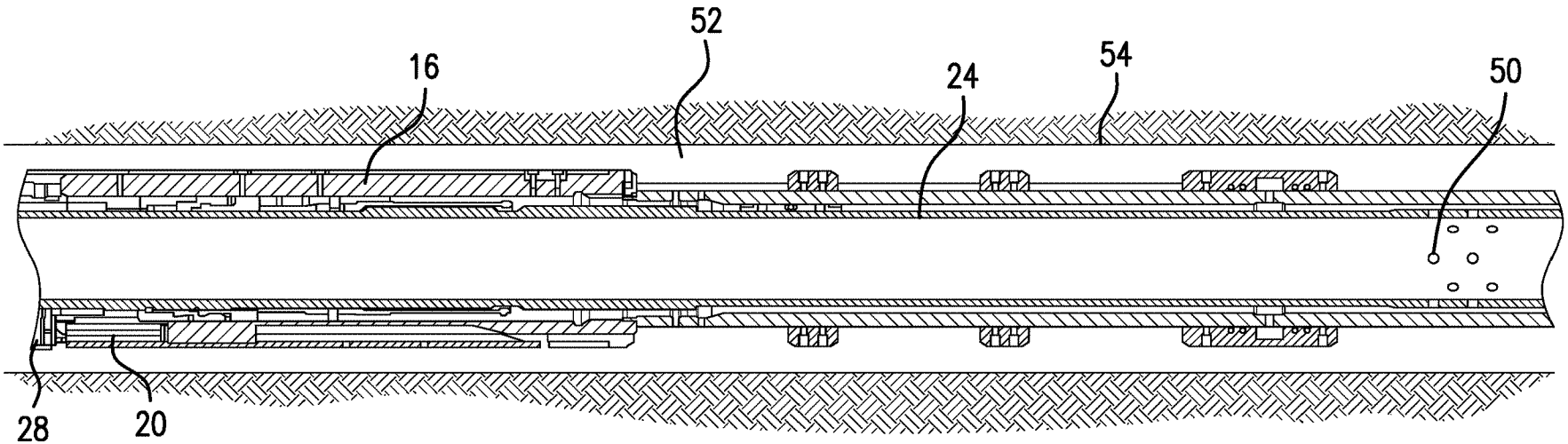
Figure 6E:
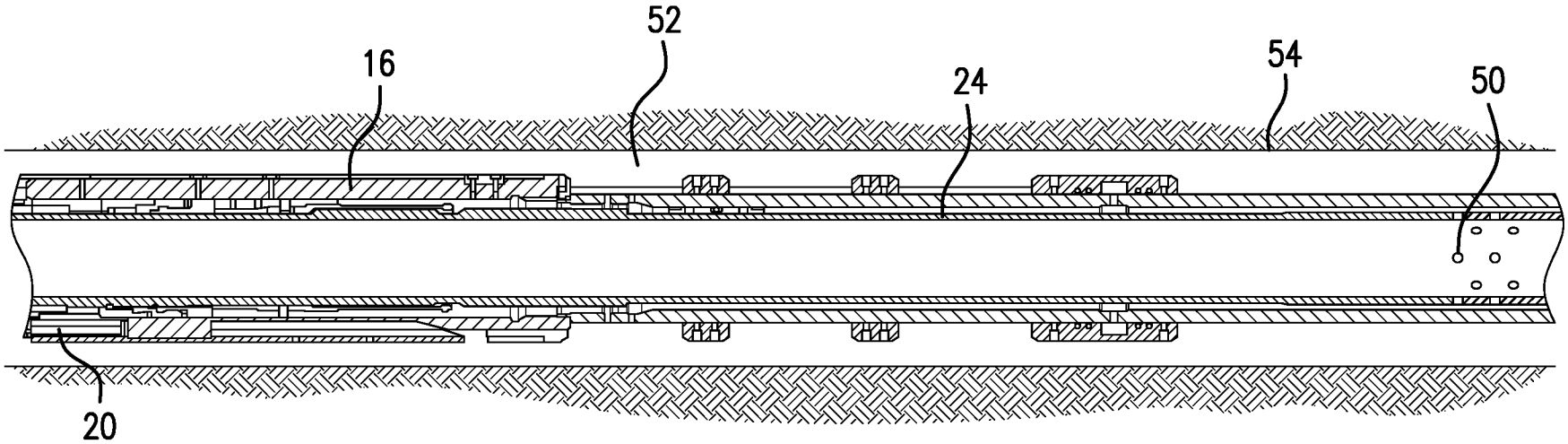

Referring to FIG. 6A, assembly 14 has started to engage with assembly 12 such that the tubular 24 is partially disposed within the mandrel 48. In this position fluid pumped through tubular 24 may flow out of openings 50 into an annulus 52 around the system 10 contained by a tubular string 54. In FIG. 6B, the mating assembly 14 has moved further into connect assembly 12 and fluid flowing through openings 50 will move directly through window 19 into pocket 18 thereby providing a flushing action. Referring to FIG. 6C, as the tubular 24 moves further into connect assembly 12, seals 26 will prevent fluid escaping from openings 50 from exiting through window 19 to annulus 52 and rather all of the fluid flowing through openings 50 will be directed through annular space 46, inlet 44, manifold 42, and into washout pathway 32 (in housing 16 and/or tubes 38 in various embodiments) and through outlet 30 into the pocket 18. By the time the system 10 is in the position of FIG. 6D, the pocket is considered clean and the next movement of the assembly 14 relative to the assembly 12 will result in the connector 20 mating with the mating connector 28. This position is shown in FIG. 6E.

Figure 7:
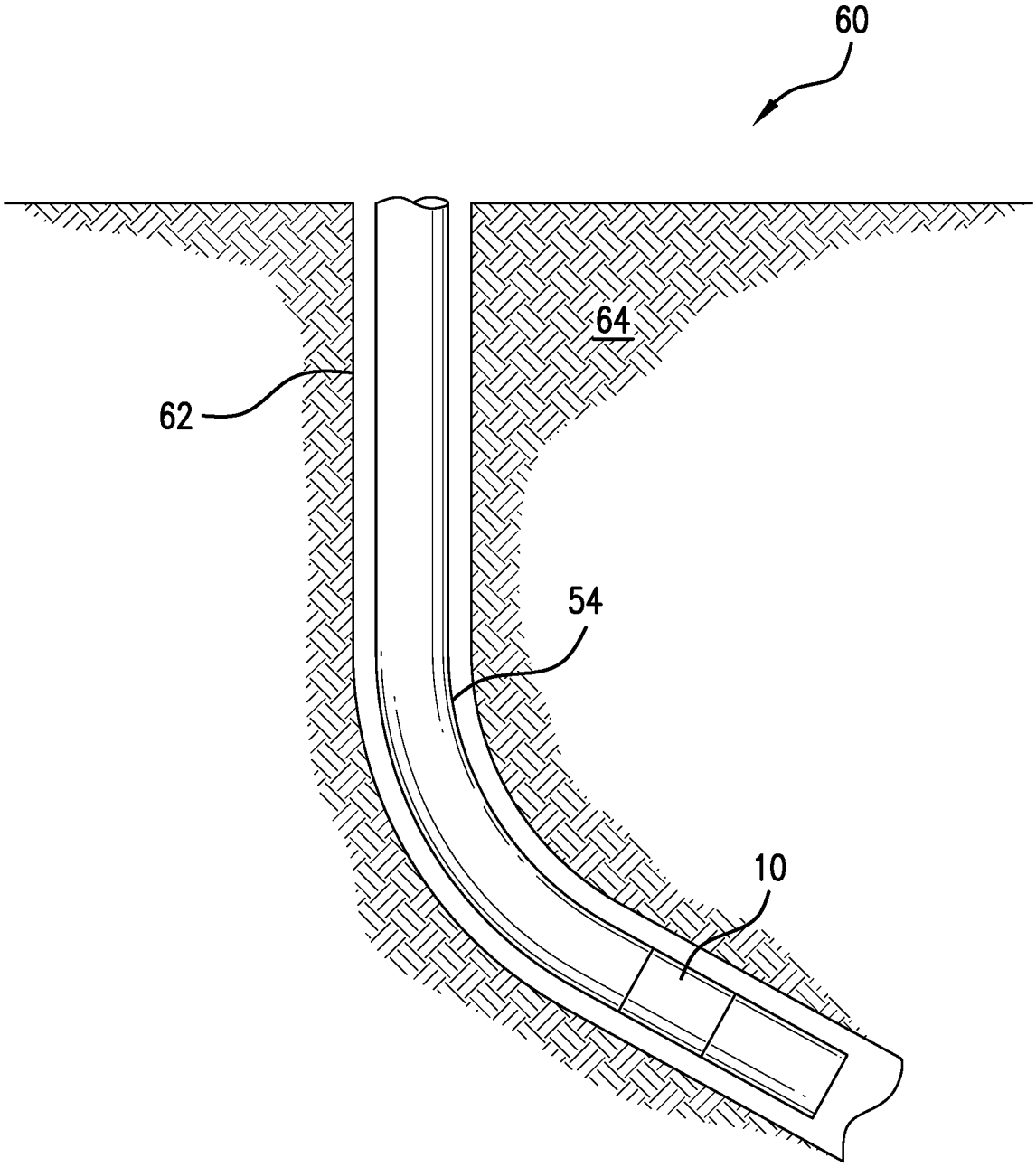
FIG. 7 is a view of a wellbore system including the wet connect system disclosed herein.

Referring to FIG. 7, a wellbore system 60 is schematically illustrated. The system 60 includes a borehole 62 in a subsurface formation 64. A string 54 is disposed in the borehole 62. A system 10 is disposed within the string 54 and may be a part of another string.

Set forth below are some embodiments of the foregoing disclosure:

Embodiment 1: A wet connect system including a connector housing, a wet connector disposed in a pocket of the housing, a washout window in the pocket and a washout outlet in the pocket, the washout outlet fluidly connected to a washout pathway, the pathway at least partially within the housing.

Embodiment 2: The system as in any prior embodiment further comprising a deflector disposed immediately downstream of the outlet.

Embodiment 3: The system as in any prior embodiment further comprising an inlet to the washout pathway.

Embodiment 4: The system as in any prior embodiment wherein the inlet fluidly connects a supply of fluid to the washout pathway.

Embodiment 5: The system as in any prior embodiment wherein the washout pathway extends into a tube adjacent the housing.

Embodiment 6: The system as in any prior embodiment wherein the outlet is two outlets one on in each side of the pocket.

Embodiment 7: The system as in any prior embodiment wherein the window is radially aligned with the pocket.

Embodiment 8: The system as in any prior embodiment further including a sub housing disposed about the housing and fluidly connecting a volume defined radially inwardly of the housing with the washout pathway.

Embodiment 9: The system as in any prior embodiment further comprising a wet mate assembly including a mating wet connector, a mating housing within which the mating wet connector is mounted, and a mating tubular extending from the mating housing and receivable in the connector housing.

Embodiment 10: The system as in any prior embodiment wherein the mating tubular includes a number of seals disposed on a surface of the mating tubular.

Embodiment 11: The system as in any prior embodiment wherein the mating tubular defines a hole through a wall thickness of the mating tubular fluidly connecting an inside volume of the mating tubular to a volume external to the mating tubular.

Embodiment 12: A method for wet connecting in a borehole including pumping fluid through a washout pathway in the wet connect system as in any prior embodiment.

Embodiment 13: The method as in any prior embodiment further including running a mate assembly that includes a mating wet connector, a mating housing within which the mating wet connector is mounted, and a mating tubular extending from the mating housing and receivable in the connector housing.

Embodiment 14: The method as in any prior embodiment further including stabbing the mating tubular into the connector housing.

Embodiment 15: The method as in any prior embodiment further including flushing fluid through a window radially aligned with the pocket.

Embodiment 16: The method as in any prior embodiment further including deflecting fluid moving through the outlet.

Embodiment 17: A wellbore system including a borehole in a subsurface formation, a string in the borehole, and a wet connect system as in any prior embodiment disposed within the string.

Embodiment 18: The wellbore system as in any prior embodiment wherein the wet connect system is part of another string within the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A wet connect system comprising:

a single-piece connector housing;

a wet connector disposed in a pocket of the housing;

a washout window in the pocket and a washout outlet in the pocket, the washout outlet fluidly connected to a washout pathway, the pathway at least partially within the housing.

2. The system as claimed in claim 1 further comprising a deflector disposed immediately downstream of the outlet.

3. The system as claimed in claim 1 further comprising an inlet to the washout pathway.

4. The system as claimed in claim 3 wherein the inlet fluidly connects a supply of fluid to the washout pathway.

5. The system as claimed in claim 1 wherein the washout pathway extends into a tube adjacent the housing.

6. The system as claimed in claim 1 wherein the outlet is two outlets one on in each side of the pocket.

7. The system as claimed in claim 1 wherein the window is radially aligned with the pocket.

8. The system as claimed in claim 1 further comprising a wet mate assembly including:

a mating wet connector;

a mating housing within which the mating wet connector is mounted; and a mating tubular extending from the mating housing and receivable in the connector housing.

9. The system as claimed in claim 8 wherein the mating tubular includes a number of seals disposed on a surface of the mating tubular.

10. The system as claimed in claim 9 wherein the mating tubular defines a hole through a wall thickness of the mating tubular fluidly connecting an inside volume of the mating tubular to a volume external to the mating tubular.

11. A method for wet connecting in a borehole comprising:

pumping fluid through a washout pathway in the wet connect system as claimed in claim 1.

12. The method as claimed in claim 11 further including:

running a mate assembly that includes:

a mating wet connector;

a mating housing within which the mating wet connector is mounted; and a mating tubular extending from the mating housing and receivable in the connector housing.

13. The method as claimed in claim 12 further including stabbing the mating tubular into the connector housing.

14. The method as claimed in claim 12 further including flushing fluid through a window radially aligned with the pocket.

15. The method as claimed in claim 12 further including deflecting fluid moving through the outlet.

16. A wellbore system comprising:

a borehole in a subsurface formation;

a string in the borehole; and a wet connect system as claimed in claim 1 disposed within the string.

17. The wellbore system as claimed in claim 16 wherein the wet connect system is part of another string within the string.

18. A wet connect system comprising:

a connector housing;

a wet connector disposed in a pocket of the connector housing;

a washout window in the pocket and a washout outlet in the pocket, the washout outlet fluidly connected to a washout pathway, the pathway at least partially within the connector housing; and a sub housing disposed about the connector housing and fluidly connecting a volume, defined radially inwardly of the sub housing, with the washout pathway.

* * * * *